United States Patent [19]

Jordal

[11] Patent Number: 4,862,141

[45] Date of Patent: Aug. 29, 1989

[54] INTEGRATED SMOKE AND INTRUSION ALARM SYSTEM

[76] Inventor: Robert L. Jordal, Rte. 10, Box 351, Winston-Salem, N.C. 27127

[21] Appl. No.: 117,055

[22] Filed: Nov. 5, 1987

[51] Int. Cl.[4] ..... G08B 19/00; G08B 13/00

[52] U.S. Cl. ..... 340/521; 340/550; 340/541; 340/545; 340/693; 340/628; 200/61.84; 200/61.81

[58] Field of Search ..... 340/550, 521, 545, 546, 340/665, 693, 628–630; 200/61.93, 61.84, 61.03, 61.81; 49/74

[56] References Cited

U.S. PATENT DOCUMENTS

| | | | |
|---|---|---|---|
| 4,160,972 | 7/1979 | LaMell et al. | 200/61.84 |
| 4,258,359 | 3/1981 | McLamb | 340/546 |
| 4,419,658 | 12/1983 | Jarosz et al. | 340/693 |
| 4,449,121 | 5/1984 | Sosa | 340/550 |

OTHER PUBLICATIONS

Valcor Security Window Systems; "Installation Details with Head and Sill Channel Subframes"; 11-5-87.

Vent Alarm Corporation, Test No. 4169-All Aluminum Jalousie Window Test Report, Sep. 5, 1984.

Valcor Security Window Systems, "Madeira", Titanica, 11-5-87.

Valcor Security Window Systems "Cristalina", 11--5-87.

Clearview Corp., Models 73A,B,C, 11-5-87.

Uni-Vue, "Louvered Windows", 11-5-87.

Caribbean Business, "Valcor Now Has Windows, Doors with Built-in Security Alarms", 9-3-87.

*Primary Examiner*—Donnie L. Crosland

[57] ABSTRACT

An integrated smoke and intrusion alarm system is provided for windows, doors or other openings in exterior building walls and includes a solar battery charging device and a magnetic test switch. The integrated alarm system is concealed from view and includes a frame assembly with apertures whereby smoke inside the building is easily detected.

16 Claims, 4 Drawing Sheets

INTEGRATED SMOKE AND INTRUSION ALARM SYSTEM

BACKGROUND OF THE INVENTION

1. Field of the Invention

The present invention relates to an electronic system for detecting smoke or intrusion in a building and particularly to a system which is built into building wall openings such as for windows or doors.

2. Description of the Prior Art and Objectives of the Invention

Both conventional and jalousie windows have utilized alarm systems in the past for detecting intrusion or unauthorized entry and many modern fire codes require the strategic placement of smoke alarms throughout buildings to insure the early detection and safety of its occupants in the event a fire occurs. Conventional smoke detectors are usually mounted on walls or ceilings and are somewhat unattractive but are usually tolerated due to local fire code requirements and the benefits provided.

Conventional intrusion alarm devices can be concealed in windows and doors and oftentimes are joined to a central power source as are some smoke detectors whereby failure of the power source prevents one or more of the detector sensors and signals from properly functioning and providing warnings for the building occupants.

Therefore, with the known disadvantages and problems associated with conventional alarm and smoke detecting devices, the present invention was conceived and one of its objectives is to provide an integrated smoke and intrusion alarm system for building wall openings which may be subject to instrusion such as windows, doors and the like which is not dependent on a central power supply.

It is another objective of the present invention to provide an integrated alarm system which is concealed in the door or window frame assembly during building construction or installation but which can be easily removed thereafter as required and which includes an individual power supply in the form of batteries for each door or window so protected.

It is still another objective of the present invention to provide a solar battery charging system for each installation to insure long life for the power supply and to insure relatively little maintenance for the owner.

It is also an objective of the present invention to provide an alarm system having a concealed, magnetically activated test switch in order to conveniently conduct periodic tests of the system.

It is still yet another objective of the present invention to provide an alarm system which is relatively inexpensive and which can be positioned in the upper section of a window or door during building construction or which can be retrofitted into existing buildings with relative ease.

Various other objectives and advantages of the present invention will become apparent to those skilled in the art as a more detailed explanation is presented below.

SUMMARY OF THE INVENTION

The aforesaid and other objectives are realized by an integrated alarm system which includes means for both intrusion detecting and smoke detecting which are electrically joined and compactly located in the upper section of a door or window frame assembly. Smoke within a room can circulate through the alarm system or intrusion detected within the building will cause the system to emit a loud, shrill sound and illumination will notify the occupants of the impending danger. Intrusion detection will cause an intermittent audio alarm and a flashing illumination to bring attention to the building occupants of a pending intrusion. The intermittent audio alarm and flashing illumination will continue for a period of thirty (30) seconds after detection has stopped.

DESCRIPTION OF THE PREFERRED EMBODIMENT

Figure 1:
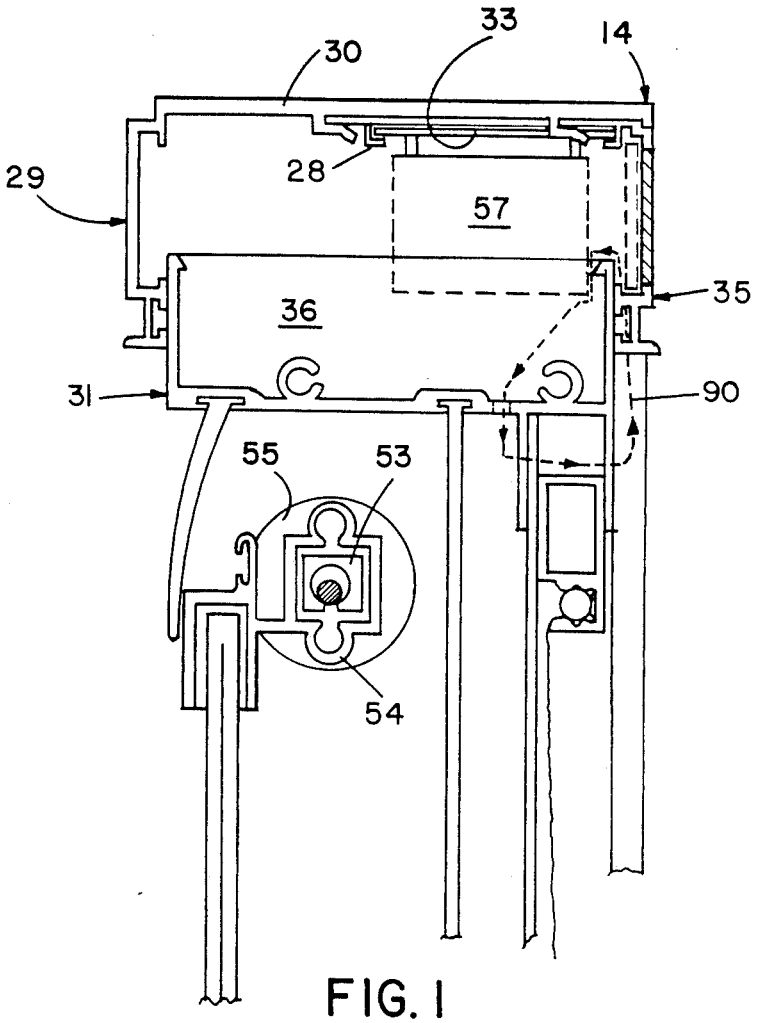
FIG. 1 demonstrates the invention in a left side partial cross-sectional view of a jalousie type window having the integrated alarm system positioned within the head or upper section.

The preferred form of the invention is shown in FIG. 1 having a frame assembly for a jalousie-type window with a starter member, a header, a detecting device holding member, and a filler member along with side window jambs and a sill (not shown). Within the upper section of the window frame assembly, a substantially rectangular compartment is formed for placement and concealment of integrated smoke and intrusion detector housings including various electrical components and circuitry.

Figure 2:
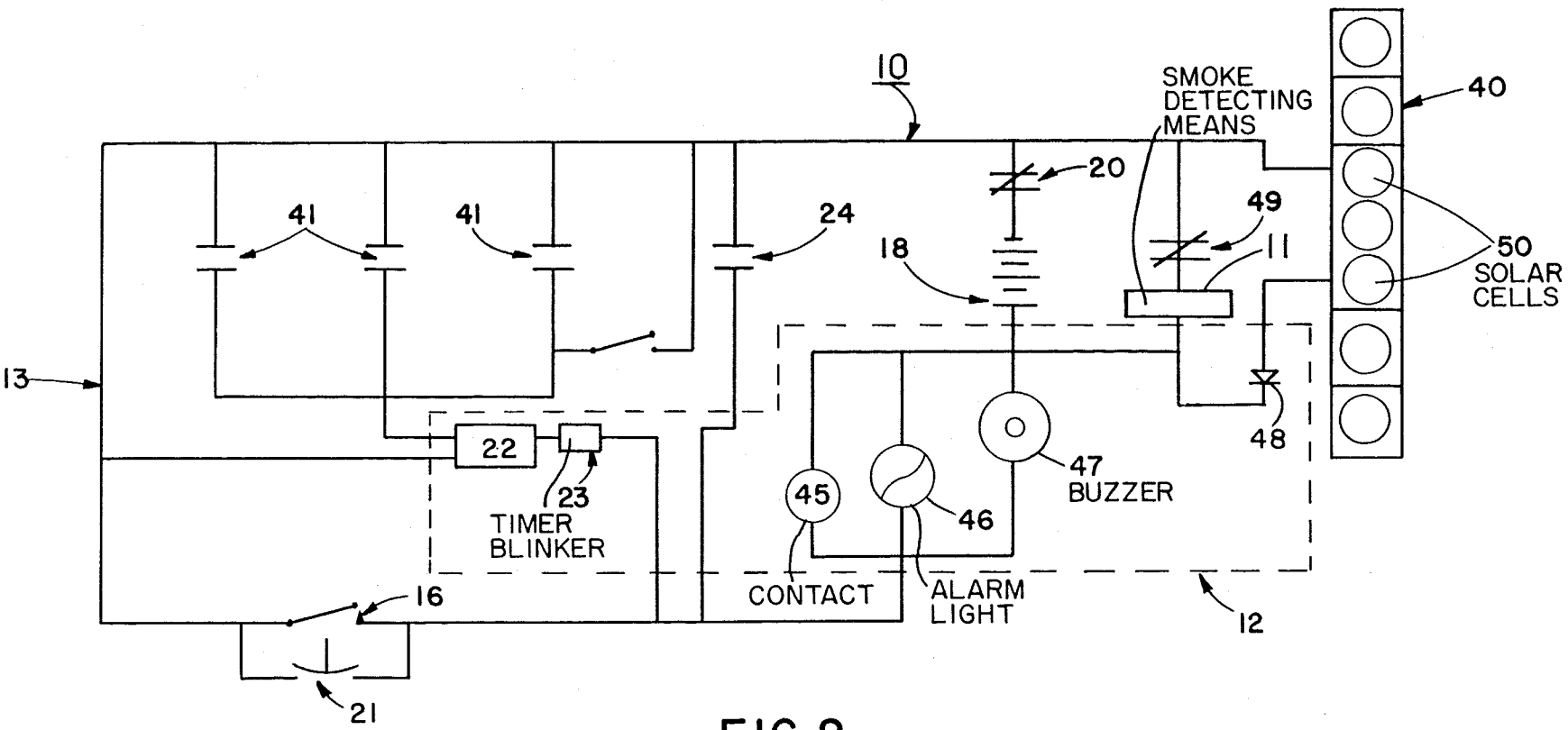
FIG. 2 shows an electrical schematic of the integrated alarm system of the invention.

Apertures within the frame assembly provide easy access and circulation by smoke from within the building to contact the smoke detector sensor which will immediately cause an alarm to sound to alert the building occupants. An anti-tamper switch prevents unauthorized removal of the alarm system and solar cells which use light from the interior of the room maintain the battery power source of the alarm system with sufficient voltage. The preferred electrical circuitry is shown in FIG. 2 and as would be understood, is provided with three exterior intrusion contacts which, of course, would be available for three (3) separate windows which may be mounted side-by-side.

DETAILED DESCRIPTION OF THE DRAWINGS AND OPERATION OF THE INVENTION

Figure 3:
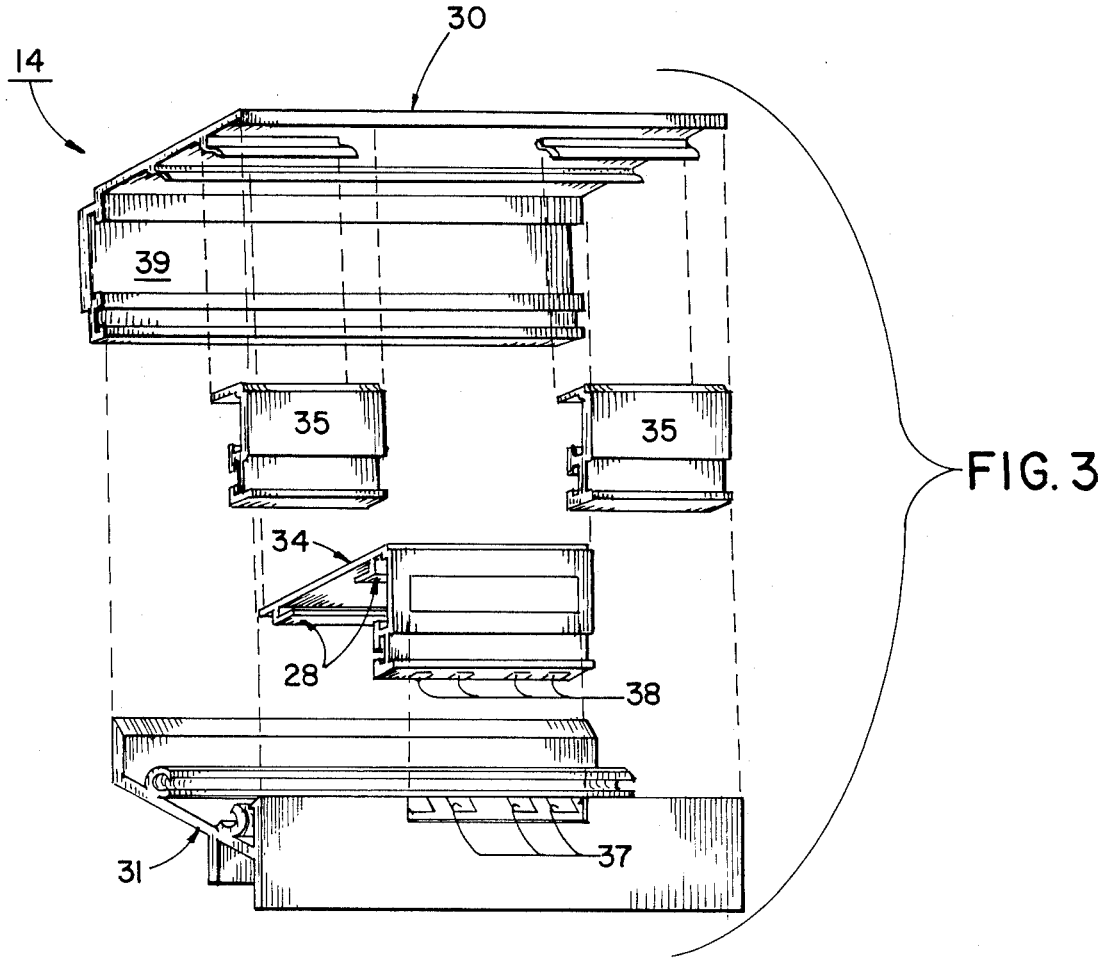
FIG. 3 demonstrates a typical upper section of a window frame assembly of the invention in exploded fashion.
Figure 4:
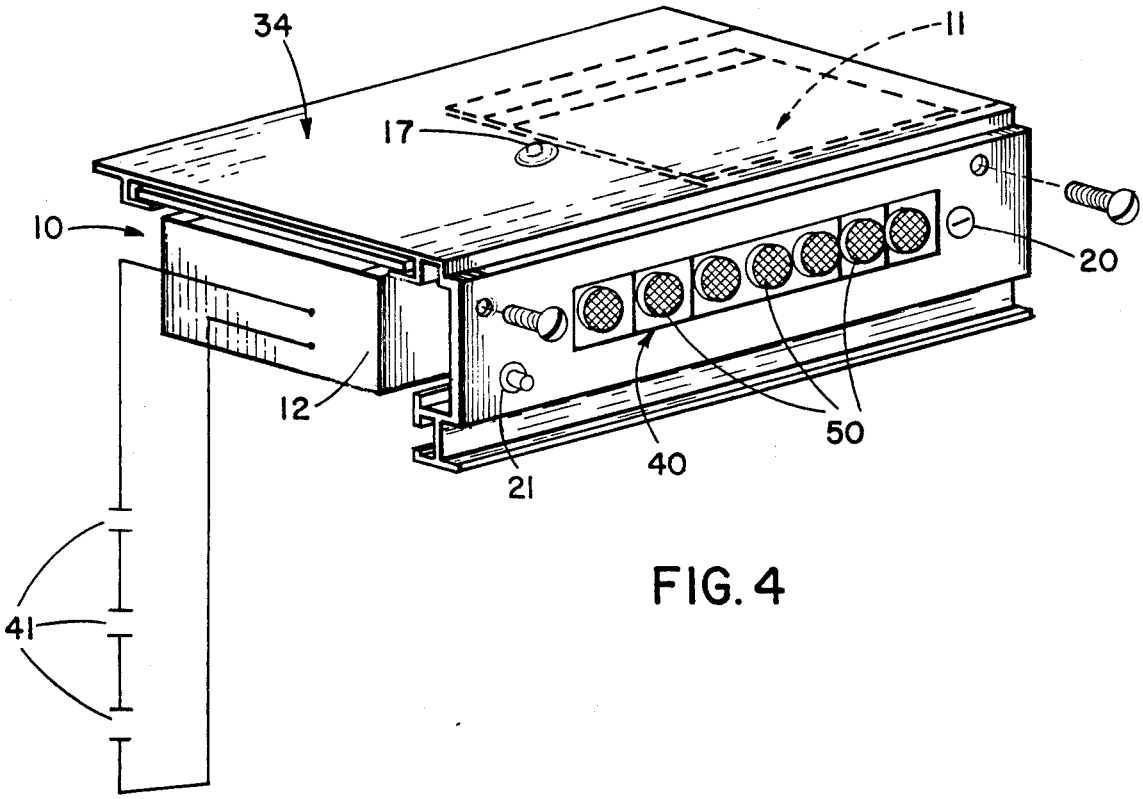
FIG. 4 pictures a perspective view of the detecting device holding member of the frame assembly removed therefrom with the alarm system in place.
Figure 5:
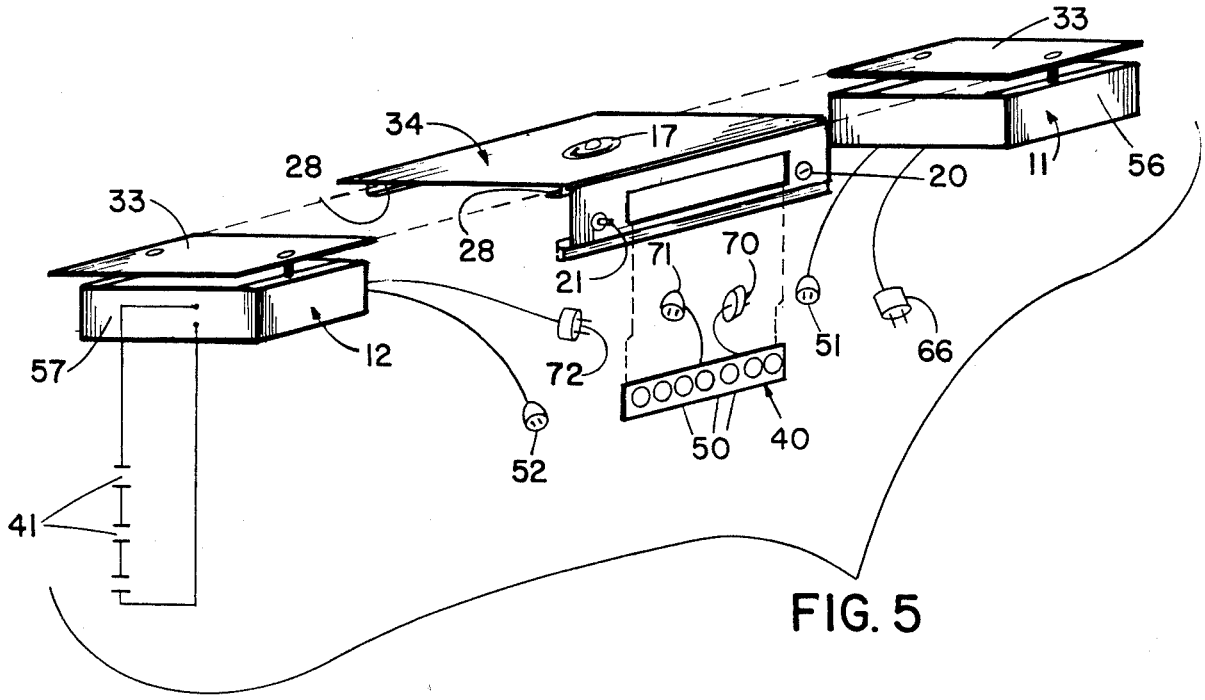
FIG. 5 depicts the detecting device holding member with the alarm components removed therefrom.

Turning now to the drawings, frame assembly 14 as shown in FIG. 3 illustrates the upper section of a jalousie window in exploded fashion for clarity. Starter member 30 is placed against the top of a rough wall opening in a building wall with starter flange member 39 being on the exterior side of the wall. Header 31 represents the top portion of frame assembly 14 as seen in FIG. 1. Thus, between starter member 30 and header 31, a substantially rectangular compartment 36 is formed for receiving the electrical circuit 13 of alarm system 10 (as shown in FIG. 2). Integrated alarm system 10 is enclosed in housings 56 and 57 attached to detecting device holding member 34 as shown in FIGS. 4 and 5 with alarm system 10 connected and removed therefrom, respectively. Filler members 35 as seen in FIG. 3 are placed alongside of detection device holding member 34.

As would be understood from the drawings and particularly FIG. 5, detecting device holding member 34 includes slide receptacles 28 for receiving two (2) alarm slides 33 for attachment to intrusion detecting means 12 and smoke detecting means 11 and for insertion on opposite sides of holding member 34. Smoke detecting means 11 and intrusion detecting means 12 are electrically joined and are connected to solar power charging means 40 having solar cells 50 thereon. Male plug 51 attached to smoke detecting means 11 is received in female plug 52 of intrusion detecting means 12 as shown in FIG. 4 and plus 66 is attached to solar power charging means 40. Intrusion contacts 41 as also shown in FIG. 4 are attached to a torque tube 54 as shown in FIG. 1 whereby the deflection of alarm bar 53, for example by prying as may be done by a burglar in attempting entry, will cause alarm bar 53 and torque tube 54 to touch, and such contact will act as a closed switch and thereby activate intrusion detecting means 12 to provide a warning signal. As would be further understood, torque tube 54 and alarm bar 53 are separated and not in contact during normal window use conditions due in part to plastic end bearings 55 (FIG. 1). In a typical jalousie type with three (3) louver blades, the three (3) torque tubes would be electrically joined as would the three (3) alarm bars, thus intrusion at any louver would activate intrusion detecting means 12.

As seen in window upper section 29 of FIG. 1, intrusion detecting means 12 (FIG. 5) is contained within a plastic or metal housing 56 and contains various electronic components therein. As shown in FIG. 2, smoke detecting means 11 comprises battery 18, annunciator 47 and remote test switch 21 all contained within smoke detecting means housing 56 (FIG. 5) whereas intrusion detector housing 57 includes timer 22, timer blinker 23 and contacts 45 for connecting to an auxiliary alarm, a telephone dialer, lights or otherwise as desired by the user. Also included within housing 57 is alarm light 46, and diode 48 which prevents drainage from battery 18 (when solar cells 50 are not charging) consisting of a nine (9) volt DC battery. The bottom of housings 56 and 57 includes openings for sound and light transmission. Also shown in FIG. 2 are disarm key switch 20, magnetically activated test switch 16 and remote test switch 21, as also seen in FIG. 4. Three (3) alarm contacts 41 as shown in FIG. 2 are provided for three (3) side-by-side jalousie windows although more or less numbers of contacts can be provided for more or less windows, or windows with other configurations. As previously mentioned, when activated by an intruder, alarm light 46 will intermittently emit light and buzzer 47 will intermittently sound, drawing occupant attention thereto. Upon deactivation by the intruder, alarm light 46 will continue to flash and buzzer 47 will continue to sound for an additional thirty (30) seconds.

Anti-tamper switch 17 as shown in FIGS. 1, 2, 4 and 5 prevents unauthorized removal of the intrusion detecting means. If unauthorized removal is attempted, a spring-loaded plunger will move upwardly, thereby activating buzzer 47. Remote test switch 21 as shown in FIG. 2 and magnetic test switch 16 can be used to determine if alarm system 10 is operating properly. Magnetic test switch 16 is activated by placing a small permanent magnet (not shown) on the outside of detecting device holding member 34 at the approximate location indicated by 21 whereby electricity will flow from battery 18 to buzzer 47, alarm light 46 and remote N/O and N/C contacts 45 for connection to auxiliary signalling devices as previously disussed above. Thus, the electrical circuitry 13 as well as audible buzzer 47 can be tested. Smoke detecting means 11 incorporates an internal test switch 49 (FIG. 2) which is activated by either manual magnetic test switch 16 or remote test switch 21 which causes smoke alarm contact or smoke sensor 24 to close, initiating a steady response from internal buzzer 47 contained within housing 56. As would be further understood, in normal operation with no smoke or intruder present, buzzer 47 along with intruder alarm light 46 and contacts 45 receive no power or electricity and solar power supply charging means 40 continuously charges battery 18 during normal daylight hours. In the event of intrusion, with one or more contacts 41 closed, electricity flows thereby activating timer 22, timer blinker 23, activating buzzer 47, intrusion alarm light 46 and contact 45. Buzzer 47, alarm light 46 and contact 45 stay activated for approximately thirty (30) seconds after the closing of contacts 41. Alarm light 46 provides room or window illumination through openings 37 in header 31 as shown in FIG. 3.

In the event that smoke sensor 24 which is positioned in the bottom of housing 56 as shown in FIG. 5 senses smoke from a fire or otherwise, an electrical signal is sent to buzzer 47 and alarm light 46 whereby alarm light 46 is illuminated and buzzer 47 provides a loud, steady, constant, audible signal. The audible sound and illumination from light 46 continues until sensor 24 can no longer detect smoke. As shown in FIGS. 1 and 3, smoke can contact sensor means 24 by either entering apertures 37 on header 31 or can contact sensor 24 by entering passageways 38 along the bottom of holding member 34 as seen in FIG. 3. Smoke entering holding member passageways 38 will circulate to contact smoke detecting means sensor 24 and thereafter can pass out through apertures 37 as seen in smoke path 90 in FIG. 1. Such circulation allows for a faster and more accurate environment determination. Alarm key switch 20 will allow installation and maintenance personnel to remove or insert alarm system 10 or components thereof without disturbing other building occupants by inadverent response from buzzer 47 since key switch 20 will turn off alarm system 10 as needed. Also, the connections between intrusion detection means 12 and smoke detecting means 11 are seen in FIG. 5. Male plug 72 connects to solar charging means 40 through female connector 71 and female connector 52 is joined to male connector 66. Solar panel male connector 70 joins female connector 51 on smoke detecting means 11 to complete the electrical circuitry.

The illustrations and examples provided herein are for explanatory purposes and are not intended to limit the scope of the appended claims.

I claim:

1. An alarm system for placement in a wall opening of a building such as with a window or door comprising: a frame assembly, said frame assembly having:

(a) a header, (b) a starter member, and (c) a detecting device holding member, said header joined to said starter member, said detecting device holding member joined to said starter member to form a container, said header defining a smoke entry aperture, said detecting device holding member defining a smoke entry aperture, means to detect smoke, means to detect intrusion, alarm circuitry, said alarm circuitry connected to said smoke detecting means and to said intrusion detecting means, said smoke and intrusion detecting means removably attached to said detecting device holding member and concealed within said container, said header aperture and said holding member aperture coincidentally mounted to allow smoke to pass through said header to said smoke detecting means contained within said holding member and wherein said alarm circuitry includes a power supply.

2. An alarm system as claimed in claim 1 and including an intrusion alarm contact, said alarm contact positioned exteriorly of said frame assembly and joined to said electrical circuitry.

3. An alarm system as claimed in claim 1 and including a magnetic test switch, said test switch attached to said electrical circuitry.

4. An alarm system as claimed in claim 1 and including an anti-tamper switch, said anti-tamper switch connected to said electrical circuitry.

5. An alarm system as claimed in claim 1 and including intrusion annunciating means, said annunciating means electrically communicating with said intrusion detecting means.

6. An alarm system as claimed in claim 1 and including a power supply, said power supply connected to said electrical circuitry.

7. An alarm system as claimed in claim 6 and including solar power supply charging means, said charging means joined to said electrical circuitry for charging said power supply.

8. An alarm system as claimed in claim 1 and including a key switch, said key switch connected to said electrical circuitry.

9. An alarm system as claimed in claim 1 wherein said frame assembly includes a slot, said slot for receiving a solar power supply charging means.

10. An alarm system as claimed in claim 1 wherein said header includes a plurality of apertures to allow smoke within the building to contact said smoke detecting means contained within said frame assembly.

11. An alarm system as claimed in claim 1 wherein said detecting device holding member includes a slot, said slot for containing a solar power supply charging means.

12. An alarm system as claimed in claim 1 and including an intrusion alarm contact, said contact mounted exteriorly of said frame assembly and in electrical communication with said alarm circuitry.

13. An alarm system as claimed in claim 1 wherein said detecting device holding member includes a slide receptacle, said smoke detecting means having a slide, said slide for engaging with said slide receptacle to thereby mount said delecting means to said holding member.

14. An alarm system comprising: a header, a starter member, a detecting device holding member, said header joined to said starter member, said detecting device holding member joined to said starter member, said header, starter member and said holding member forming a container, a means to detect smoke, a first alarm slide for mounting said smoke detecting means within said holding member, said first alarm slide joined to said smoke detecting means, means to detect intrusion, a second alarm slide for mounting said intrusion detecting means within said holding member, said second alarm slide joined to said intrusion detecting means, a slide receptacle, said slide receptacle attached to said holding member, said slide receptacle adapted for receiving said first and said second alarm slides for mounting said smoke and said intrusion detecting means within said container, and an anti-tamper switch to prevent unauthorized removal of said intrusion detection means, said switch connected to said holding member.

15. An alarm system as claimed in claim 14 and including a means for providing an audible alarm, said alarm means connected to said smoke detecting means to provide a constant audible signal and said alarm means connected to said intrusion detecting means to provide an intermittent audible signal.

16. An alarm system as claimed in claim 15 and including means to charge a power supply, said power supply charging means comprising a solar power supply charging means.

* * * * *